US009173465B2

(12) United States Patent
Morgandi et al.

(10) Patent No.: US 9,173,465 B2
(45) Date of Patent: Nov. 3, 2015

(54) DEVICE FOR CURLING HAIR AND/OR STYLING HAIR

(75) Inventors: Arturo Morgandi, Azzano San Paolo (IT); Marco Rivola, Azzano San Paolo (IT)

(73) Assignee: TENACTA GROUP S.p.A., Azzano San Paolo (IT)

( * ) Notice: Subject to any disclaimer, the term of this patent is extended or adjusted under 35 U.S.C. 154(b) by 0 days.

(21) Appl. No.: 12/940,452

(22) Filed: Nov. 5, 2010

(65) Prior Publication Data

US 2011/0108052 A1 May 12, 2011

(30) Foreign Application Priority Data

Nov. 6, 2009 (IT) ..... MI2009A1946

(51) Int. Cl.
*A45D 1/08* (2006.01)
*A45D 1/04* (2006.01)
*A45D 1/06* (2006.01)

(52) U.S. Cl.
CPC .. *A45D 1/08* (2013.01); *A45D 1/04* (2013.01); *A45D 1/06* (2013.01)

(58) Field of Classification Search
CPC ..... A45D 1/04; A45D 1/06; A45D 1/08; A45D 2/001; A45D 2001/004
USPC ..... 132/224, 226–232, 237–242, 268–269; 219/225; 3/224, 226–232, 237–242, 3/268–269
IPC ..... A45D 1/04
See application file for complete search history.

(56) References Cited

U.S. PATENT DOCUMENTS

| | | | | |
|---|---|---|---|---|
| 2,218,298 | A * | 10/1940 | Heliodoro | 132/237 |
| 4,479,047 | A * | 10/1984 | Khaja et al. | 219/225 |
| 4,740,669 | A * | 4/1988 | Takimae | 219/225 |
| 5,119,847 | A * | 6/1992 | Powell et al. | 132/226 |
| 6,191,387 | B1 * | 2/2001 | Smal | 219/225 |
| 6,653,599 | B2 * | 11/2003 | Nam | 219/222 |
| 8,013,274 | B2 * | 9/2011 | Suzuki et al. | 219/225 |
| 2005/0022836 | A1 | 2/2005 | Tong | |
| 2005/0081876 | A1 * | 4/2005 | Choi | 132/224 |
| 2005/0172979 | A1 * | 8/2005 | Saida et al. | 132/228 |
| 2005/0172980 | A1 * | 8/2005 | Julemont | 132/231 |

(Continued)

FOREIGN PATENT DOCUMENTS

| | | | |
|---|---|---|---|
| EP | 1417905 | A1 | 5/2004 |
| EP | 1967088 | A1 | 9/2008 |

(Continued)

OTHER PUBLICATIONS

Japanese Office Action dated Dec. 2, 2014, issued in corresponding Japanese application.

*Primary Examiner* — Rachel Steitz
*Assistant Examiner* — Jennifer Gill
(74) *Attorney, Agent, or Firm* — Husch Blackwell LLP

(57) ABSTRACT

A device for curling hair, and/or styling hair includes a handle, a first arm and a second arm. The first and second arms are arranged side-by-side and parallel to one another and extend substantially along a longitudinal axis of the device. The device includes at least one heating element for heating the first and/or second arm. At least the first arm includes a fixed hemi-arm that is solid with the handle and fixed in orientation and a mobile hemi-arm elastically supported by and movable relative to said fixed hemi-arm.

14 Claims, 7 Drawing Sheets

(56) References Cited

U.S. PATENT DOCUMENTS

| | | | | |
|---|---|---|---|---|
| 2006/0037625 | A1 | 2/2006 | Kayser et al. | |
| 2006/0076032 | A1 | 4/2006 | Fung | |
| 2006/0196523 | A1* | 9/2006 | Choi | 132/224 |
| 2007/0240731 | A1* | 10/2007 | Mukai | 132/224 |
| 2009/0032048 | A1* | 2/2009 | Suzuki et al. | 132/224 |
| 2009/0260651 | A1 | 10/2009 | Chan | |
| 2010/0101599 | A1* | 4/2010 | Choi | 132/269 |
| 2010/0170883 | A1* | 7/2010 | Legrain et al. | 219/225 |
| 2010/0242985 | A1* | 9/2010 | Kaizuka | 132/224 |
| 2011/0174331 | A1* | 7/2011 | Kim | 132/229 |
| 2012/0024311 | A1* | 2/2012 | Linglin et al. | 132/232 |

FOREIGN PATENT DOCUMENTS

| | | | |
|---|---|---|---|
| EP | 2165620 | A1 | 3/2010 |
| FR | 2600509 | A1 | 12/1987 |
| JP | 51-110779 | U | 9/1976 |
| JP | 2008253745 | A | 10/2008 |
| WO | 9835578 | A1 | 8/1998 |

* cited by examiner

DEVICE FOR CURLING HAIR AND/OR STYLING HAIR

CROSS-REFERENCE TO RELATED APPLICATIONS

The present application claims priority to and incorporates herein by reference Italian Patent Application Serial No. MI2009A001946 filed on Nov. 6, 2009

BACKGROUND OF THE INVENTION

The present invention refers to a device for curling and/or styling hair, in particular an electric device for curling hair and/or styling hair.

PRIOR ART

As known, electric devices for curling hair are widely used both in the home and in professional salons.

The conventional method of curling and/or styling a lock of hair consists of winding the hair around a cylinder that can be heated, letting the lock rest for some minutes and then unwinding it. The lock of hair thus takes up a curled shape, defined by winding around the heated cylinder during the resting time.

In order to carry out a process of this type, a so called curling iron is used, which is typically equipped with a cylinder that can be heated on its entire surface and a clamp connected to a lever that is suitable for being actuated by the user of the device, as shown, for example, in the European patent application EP 1.417.905 and in the American patent applications US 2005-0022836 and US 2006-076032. By applying pressure on the lever, the clamp opens, promoting the insertion of a lock of hair between the cylinder and the clamp; by releasing the lever, the clamp goes back into contact with the cylinder, locking the lock of hair above them. Once the lock of hair is locked between the clamp and the cylinder, the user rotates the device, manually or through a motor, so as to curl the remaining part of such a lock of hair around the cylinder. Consequently, the entire length of the lock is wound around the heated cylinder and is left to rest for an amount of time that is sufficient to set the hair in the desired manner. At the end of such an operation, the user can release the hair by pressing the lever once again so as to open the clamp.

These curling irons, however, have the drawback that the pressure action of the lever to release the lock of hair is made rather difficult by the fact that the hair wound around the cylinder is also wound around the clamp. Moreover, following the rotation of the hair setting iron, the lever that actuates the clamp for releasing the hair is often not in a position where it can be easily actuated by the user. Moreover, when the hair is wound around the curling cylinder, it can also inadvertently wind around the part of handle where the lever for releasing the hair itself is located, making the pressing of such a lever even more problematic.

Another drawback of such curling irons is caused by the fact that the time in which the lock of hair must be left to rest, in order to obtain satisfactory results, is particularly long, such an operation having to be then repeated for each lock to be curled. A further drawback is that if the lock is wound in the direction in which the lock comes against the clamp, an undesired hair set with an unpleasant appearance is created.

In recent years, a second curling method has been used that employs a so called plate, i.e. a tool with two elongated and flat arms, with opposite clamps, with inner surfaces facing each other and heated, whereas the outer surfaces cannot be heated; a plate is described for example in the American patent application US 2006-0037625. It should be noted that a tool of this type—operated in a different way, fundamentally static—is more often used for straightening hair and is thus also known as a hair straightener. The lock of hair is wound around the plate and is kept tight; then, the plate is made to rotate by 180° or by 360° in the winding direction of the lock. Then the plate is made to slide from top to bottom, keeping the lock tight with the other hand. Once the lock has been released, it has taken up a curled shape due to the fact that it has been wound around the heated plate. It would not be possible to use this sliding method with the aforementioned curling irons since the lock of hair is locked by the clamp and therefore a downwards sliding of the curling iron could pull out part of the hair.

This second method makes it possible to reduce the work time necessary for curling and/or styling hair, however, it does have some drawbacks. Indeed, the result obtained with such a method based on a plate takes less time with respect to that obtained with the method described above using the curling iron, due to the fact that the hair is heated only when it is made to pass between the arms of the plate and returns to its initial conditions over a shorter period. Moreover, it is particularly difficult to use the plate to obtain a certain curling consistency close to the roots of the hair, since the sliding space available is minimal. Another drawback is caused by the fact that it is necessary to exert a certain closure force on the plates during the sliding, and therefore this tool is awkward to use.

Basically, the result obtained with the plate is less strong and lasts less time than that obtained with the curling iron.

U.S. Pat. No. 4,479,047 describes an electric hair curling device comprising a handle and a cylinder suitable for being heated, open from top to bottom so as to form two semi-cylindrical portions and having a blade inside it along the entire length of the cylinder. In resting conditions, the blade is parallel to the inner faces of the two semi-cylinders, so that it is easy to insert the hair. Once the hair has been inserted, by manually pressing a button, the blade is rotated so as to diagonally touch the inner faces of the two semi-cylinders, thus holding the hair.

Such a device makes it possible to eliminate the undesired presence of the lever and the clamp actuated by such a lever to lock the hair. However, there are still, in any case, the problems of bulk and of poor manageability of the device due to the presence of both the blade to lock the hair, and the button to actuate such a blade. Moreover, with this device it is not possible to use the second method described, due to the fact that the blade holds the hair.

SUMMARY OF THE INVENTION

The Applicant has noted that the devices known in the prior art are difficult to manage and require very long working time to obtain results of a certain consistency.

Moreover, the Applicant has also observed that the devices according to the prior art do not make it possible to obtain a satisfactory curling of the locks of hair with a good hold over time, in particular close to the roots of the hair.

The Applicant has therefore provided a device with improved manageability, which makes it possible to reduce the working time and/or to improve the quality and the duration of the hair curling over time.

In accordance with one or more of the above aspects, a device for curling and/or styling hair is provided that includes a handle, a first arm and a second arm, in which the first and second arms are arranged side-by-side and parallel to one another and extend substantially along a longitudinal axis of the device. The first and second arms are associated with the handle at a respective first end thereof. The device includes heating means adapted for heating at least one of said first and second arms. At least the first arm includes a fixed hemi-arm solid with the handle and fixed in orientation and a mobile hemi-arm elastically supported by and movable relative to said fixed hemi-arm.

said first and second arm are arranged side-by-side and parallel to one another and extend substantially along a longitudinal axis, associated with said handle at a respective first end thereof;

said device comprises heating means adapted for heating at least one of said first and second arms;

where said first arm comprises a fixed hemi-arm solid with the handle and a mobile hemi-arm elastically supported by said fixed hemi-arm.

In the device according to the invention, when a lock of hair is inserted between the two arms, these are capable of moving away from one another so as to allow the lock to suitably be arranged along their entire length so as to undergo the curling, without using any mechanical device such as levers or clamps. Therefore, the device has a substantially improved manageability and makes it possible to considerably reduce the work time, since it allows the use of the second method of curling through sliding and the results are of better quality and last longer. The device does not have mechanical elements that can be an obstacle for the curling processes of the hair, elements such as, for example, clamps or blades and levers or buttons connected to them and that are to be actuated every time it is wished to lock or release a lock of hair to be curled. Consequently, the device can be used in a bi-directional manner, thus being more versatile and easier for the user. Moreover, the fact that there are no elements of the aforementioned type also makes it possible to bring the device for curling hair closer to the root area of the hair itself; such an area is generally difficult to reach due to the bulk of the devices known in the prior art, with the result that the locks of hair are not curled in a satisfactory manner near to the root area.

The fact that there are no mechanical elements to be actuated by the user also allows the user himself to have a free hand, so as to possibly improve the hair curling operations, by keeping for example the locks of hair tight when necessary and helping to release it at the end of the operation itself.

For the purposes of the present description and of the subsequent claims, by the expression "substantially along an axis" we mean both exactly along that axis, and along an axis the direction of which slightly differs from it. Moreover, by the expressions "substantially flat", "substantially semi-cylindrical" and "substantially cylindrical" we mean both shapes, that are respectively, flat, semi-cylindrical and cylindrical, as well as shapes that depart from them in a non visible manner, even with reference to elements that take up such shapes for almost the overall size of the element itself. Finally, by the expression "arms substantially alongside one another" we mean both arms that are against each other, and that are arranged at a very short distance from one another.

Preferably, even said second arm comprises a fixed hemi-arm solid with the handle and a mobile hemi-arm, elastically supported by said fixed hemi-arm.

In this way, both the mobile hemi-arms are capable of moving with respect to the corresponding fixed hemi-arm; consequently, when a lock of hair is inserted between said mobile hemi-arms, the space between them increases and therefore the insertion of the lock is further eased.

Each of said first and second arms may have an overall substantially semi-cylindrical shape, with a first flat face formed on said mobile hemi-arm and a second convex face formed on said fixed hemi-arm, said flat faces facing towards one another, said convex faces facing away from one another.

In such a way, there is the advantage that said first and second arm together form an element with a substantially cylindrical shape, which is the most appropriate shape for an element around which a lock of hair must be wound so as to form a curl.

In rest conditions of the device, said mobile hemi-arm of said first arm and said mobile hemi-arm of said second arm may be substantially alongside one another for the entire length of said arms.

In rest conditions of the device, said mobile hemi-arm of said first arm and said mobile hemi-arm of said second arm may be arranged at a predetermined distance from one another.

The heating means may comprise one first and one second heating element, housed in a respective one of said mobile hemi-arms; alternatively, said heater may be housed in a respective one of said fixed hemi-arms; more preferably, said at least one heating element is suitable for heating both said mobile hemi-arms and said fixed hemi-arms.

The Applicant has indeed observed that, in general, in order to obtain curls with a certain consistency and durability in a relatively short time, it is necessary that the locks of hair to be curled are wound around surfaces that are entirely heated, so that the entire lock of hair undergoes heating during all the time necessary for the setting to obtain the curling.

Preferably, each of the mobile hemi-arms comprises a head positioned at a second end of the respective arm, on the opposite side with respect to the handle.

Said heads ease guiding of the lock towards the slit between the two mobile hemi-arms.

Preferably, the head is made from heat-insulating material.

In such a way, the heat emitted by the heating means is not transmitted to the end part of the device, thus improving the manageability of the device itself and avoiding unpleasant burning of its user and/or of the person whose hair is undergoing curling.

One or both of the arms may comprise at least one rib, formed on the convex face of the respective fixed hemi-arm and extending transversally with respect to the longitudinal axis X. By this it is meant that the rib or ribs are not arranged according to the axis X, but rather at an angle with respect to it, in particular perpendicular.

The ribs act as a guide to position the lock of hair around the arms in a suitable manner, preventing the lock from coming out too easily from the hair curler device during the curling step or from folding over itself, at the same time. The lock of hair can be repeatedly wound around the arms so that each winding of the lock is arranged between two successive ribs.

The ribs of the first arm may or may not be aligned with the ribs of the second arm.

Further features and advantages of the present invention, as well as the structure and operation of various embodiments of the present invention, are described in detail below with reference to the accompanying drawings.

BRIEF DESCRIPTION OF THE DRAWINGS

Further characteristics and advantages of the device of the present invention shall become clearer from the following detailed description of some preferred embodiments, given as an example and not for limiting purposes with reference to the attached drawings. In such drawings.

DETAILED DESCRIPTION OF PREFERRED EMBODIMENTS

Figure 1:
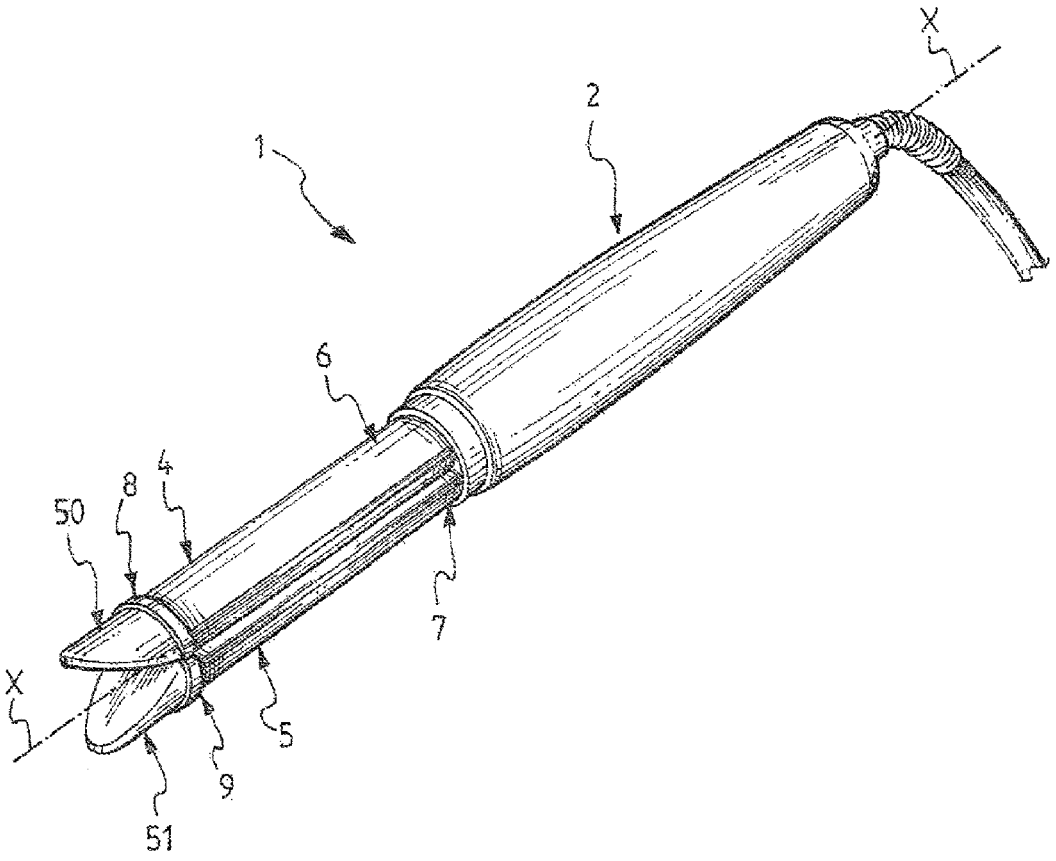
FIG. 1 is a perspective view of a first preferred embodiment of a device in accordance with the present invention.

With reference to FIGS. 1-5, 1 indicates a device for curling hair according to a first embodiment of the present invention. The device 1 comprises a handle 2, a first arm 4 and a second arm 5, substantially identical to one another and extending along a longitudinal axis X. The two arms 4, 5, are arranged side-by-side and parallel to one another and aligned with the handle 2. On one side, at its first end 6, the first arm 4 is associated with the handle 2; analogously, at its first end 7, the second arm 5 is associated with the handle 2. The two arms 4, 5 are associated with the handle 2 independently from one another.

Figure 3:
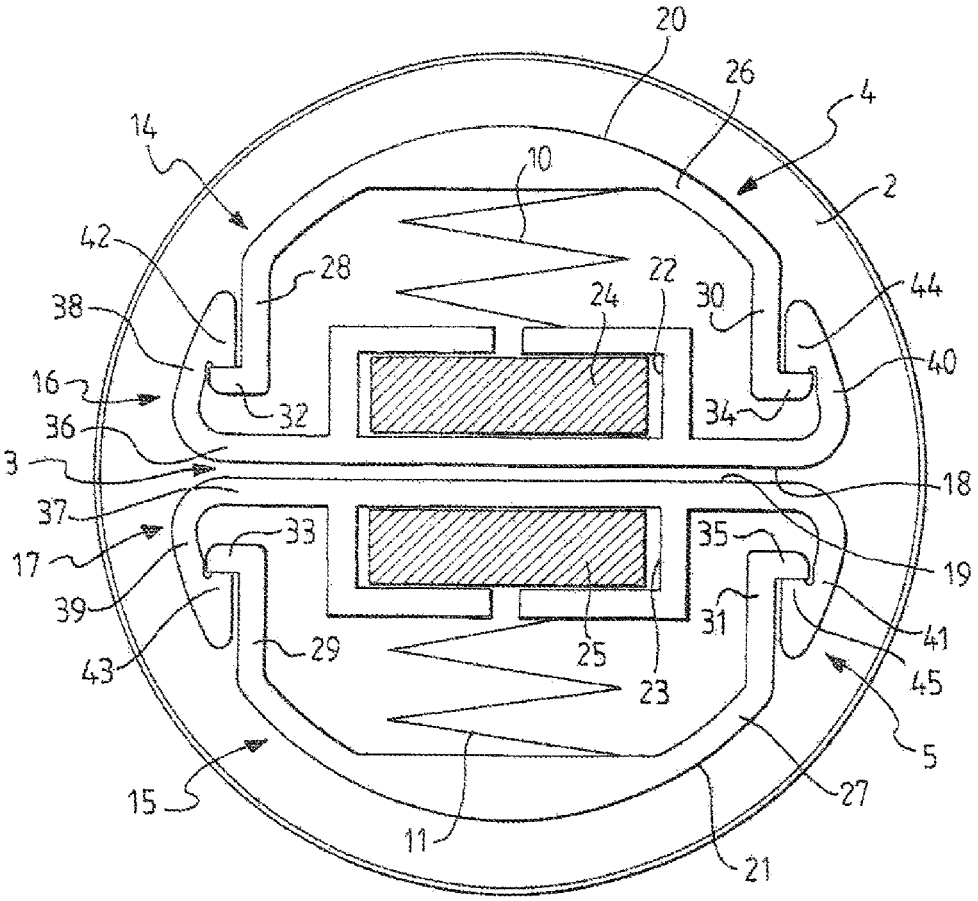
FIG. 3 is a section view of the device of FIGS. 1 and 2, taken according to the line III-III of FIG. 2.
Figure 4:
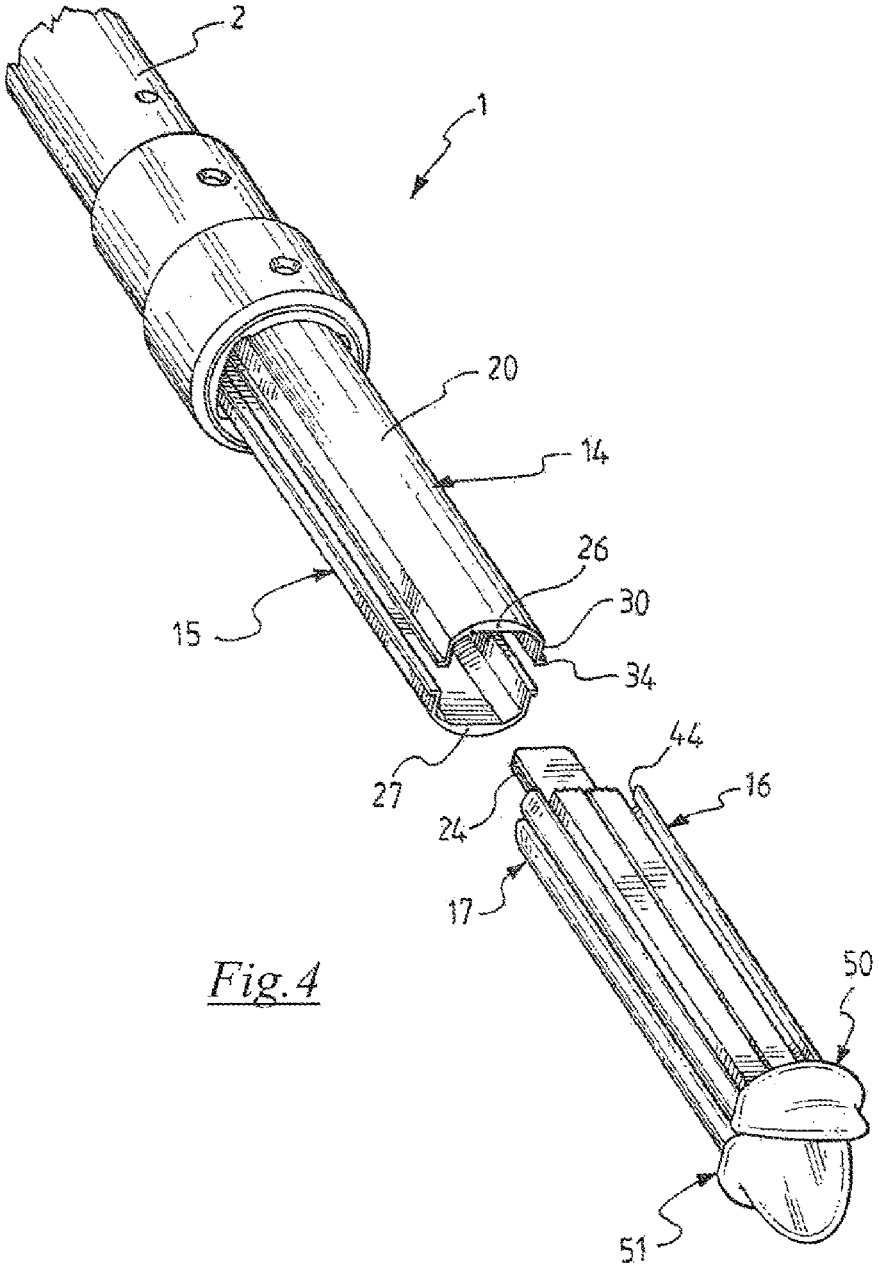
FIG. 4 is an exploded view of part of the device of FIGS. 1-3.
Figure 5:
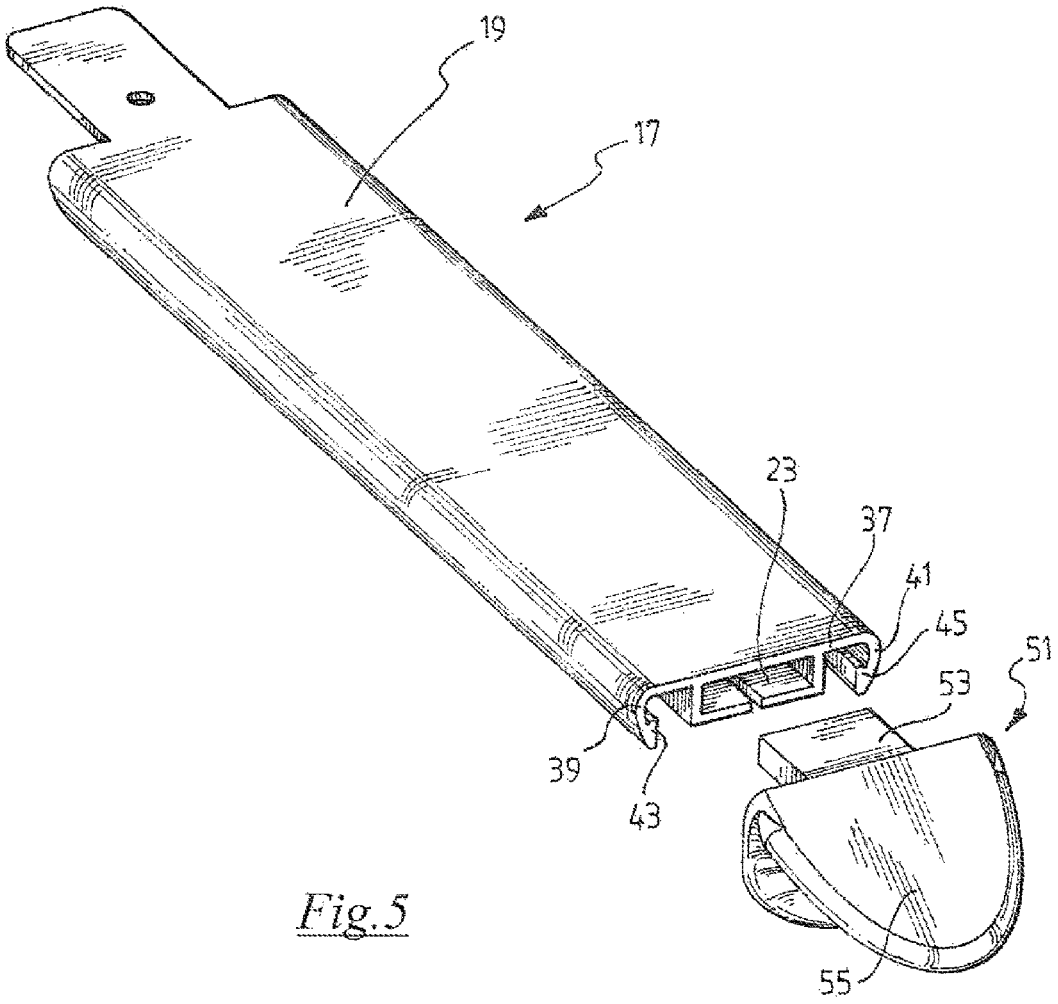
FIG. 5 is an exploded view of a detail of FIG. 4.

As illustrated in FIGS. 3-5, the first arm 4 comprises a fixed hemi-arm 14, solid with the handle 2, and a mobile hemi-arm 16, elastically supported by the fixed hemi-arm 14. Analogously, the second arm 5 comprises a fixed hemi-arm 15, solid with the handle 2, and a mobile hemi-arm 17, elastically supported by the fixed hemi-arm 15.

The first and the second arm 4, 5 have an overall semi-cylindrical shape, with first flat faces 18, 19 formed on the mobile hemi-arms 16, 17 and second convex faces 20, 21 formed on the fixed hemi-arms 14, 15; the first flat faces 18, 19 face one another, the second convex faces 20, 21 face away from one another.

Inside each mobile hemi-arm 16, 17, respective seats 22, 23, are formed, where a heating element may be housed, formed by respective heating elements 24, 25. In such a position, the heating element 24, 25, in operative conditions, is suitable for heating both the first flat face 18, 19 and the second convex face 20, 21 of the arm 4, 5. The heating elements 24 and 25 are preferably electric resistors, of a per se known type, with suitable power, for example electric resistances or PTC (positive temperature coefficient heater) or ceramic resistances (ceramic heater) such as to reach a temperature from 170° C. to 250° C.

The first flat faces 18, 19 are in front of one another, at a distance that is constant for their entire length, in the resting conditions of the device 1 illustrated in the Figures. In the embodiment shown in FIGS. 1-5, such a distance is near to zero, i.e. shorter than 2 mm; in such a way a very thin slit 3 is possibly created between the two flat faces.

The fixed hemi-arm 14 is formed by a metal profile and—if seen in section, see in particular FIG. 3—has a main portion 26, which extends according to the convex face 20, side-by-side with two opposite guide tabs 28, 30, which extend in a direction that is substantially perpendicular to the flat face 18. The guide tabs 28, 30 end with respective bosses 32, 34, projecting outwards with respect to the guide tabs 28, 30.

The mobile hemi-arm 16 is also formed by a metal profile and—if seen in section, see in particular FIG. 3—has a main portion 36, which extends according to the flat face 18, side-by-side with two opposite guide tabs 38, 40, which extend in a direction almost perpendicular to the flat face 18, facing towards the main portion 26 of the fixed hemi-arm 14. The guide tabs 38, 40 end with respective bosses 42, 44, projecting inwards with respect to the guide tabs 38, 40.

The mobile hemi-arm 16 is engaged with the fixed hemi-arm 14 through the respective guide tabs 28, 30 and 38, 40; in particular, as clearly visible in FIG. 3, the guide tabs 38 and 40 surmount the guide tabs 28 and 30, and the respective bosses 32 and 34 of the fixed hemi-arm 14 are engaged with the respective bosses 42 and 44 of the mobile hemi-arm 16, so that the disengagement of the mobile hemi-arm 16 from the fixed hemi-arm 14 is prevented.

The structure of the second arm 5 is the same as that of the first arm 4 just described. Therefore, the fixed hemi-arm 15 is formed by a metal profile and—if seen in section, see in particular FIG. 3—has a main portion 27, which extends according to the convex face 21, side-by-side with two opposite guide tabs 29, 31, which extend in a direction that is substantially perpendicular to the flat face 19. The guide tabs 29, 31 end with respective bosses 33, 35, projecting outwards with respect to the guide tabs 29, 31.

Analogously, the mobile hemi-arm 17 is also formed by a metal profile and—if seen in section, see in particular FIG. 3—has a main portion 37, which extends according to the flat face 19, side-by-side with two opposite guide tabs 39, 41, which extend in a direction that is almost perpendicular to the flat face 19, facing towards the main portion 27 of the fixed hemi-arm 15. The guide tabs 39, 41 end with respective bosses 43, 45, projecting inwards with respect to the guide tabs 39, 41.

Correspondingly, the mobile hemi-arm 17 is engaged with the fixed hemi-arm 15 through the respective guide tabs 29, 31 and 39, 41; in particular, as clearly visible in FIG. 3, the guide tabs 39 and 41 surmount the guide tabs 29 and 31, and the respective bosses 33 and 35 of the fixed hemi-arm 15 engage with the respective bosses 43 and 45 of the mobile hemi-arm 17, so that the disengagement of the mobile hemi-arm 17 from the fixed hemi-arm 15 is prevented.

Each arm 4, 5 then comprises, between its fixed hemi-arm 14 and its mobile hemi-arm 16, elastic means to elastically push the hemi-arms away from one another, so that when resting they take up the position shown in FIGS. 1-5, in particular in FIG. 3. Such elastic means, represented only schematically and indicated with reference numerals 10, 11, can be various kinds of springs (flat, helical, needle, etc.), or else groups thereof.

Each arm 4, 5 also comprises a head 50, 51 positioned at a second end 8, 9 of the second arm, on the side that is opposite with respect to the handle 2.

The head 50, 51 is mounted on the mobile hemi-arm 16, 17. For such a purpose, as shown more clearly in FIGS. 4 and 5, the head 50, 51 is provided with a tang 52, 53, inserted in the seat 22, 23, which in the part closest to the end 8, 9 is not occupied by the heating element 24, 25. The shape of the head 50, 51 is tapered, so as to have a front wall 54, 55 that is inclined with respect to the axis X; the front walls 54 and 55 of the two heads 50 and 51 face one another, so as to form a recess 60 for the insertion of locks of hair to be curled between the two arms 4 and 5. On the side opposite with respect to the inclined front wall 54, 55, the head 50, 51 has a shape corresponding to that of the arm 4, 5, so as to join with it.

Each head 50, 51 is made from heat-insulating material, for example from a suitable known plastic material, preferably of the type that can be injection moulded, such as PPS or the like.

The device 1 is then provided with electric connections (not shown in the Figures) to supply power to the heating elements 24, 25. Such connections can also comprise members for adjusting the electric power (also not shown), so as to adjust the heating of the heating elements 24, 25, in a per se known manner.

The operation of the device 1 occurs according to the following modality.

Figure 2:
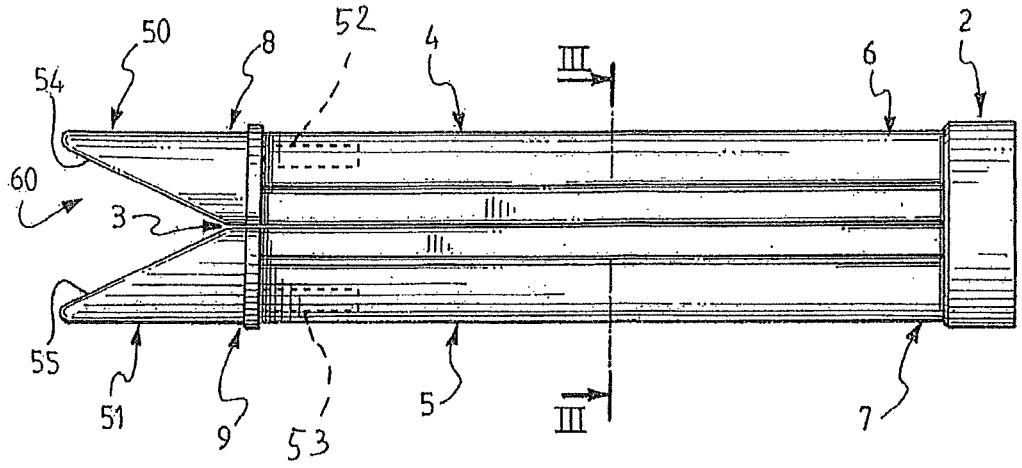
FIG. 2 is a side view of part of the device of FIG. 1.

With reference to FIGS. 1 and 2, for curling hair by using the device 1 of the present invention, the lock of hair to be curled is made to pass through the recess 60 between the heads 50 and 51 and is then guided by the user to be inserted into the slit 3 between the flat faces 18, 19 of the arms 4, 5. Consequently, the two mobile hemi-arms 16, 17 tend to move away from one another, compressing the elastic means 10, 11, and thus increasing the width of the slit 3 between them. The lock of hair remains therefore locked between the two arms 4 and 5, delicately held by the elastic thrust of the elastic means on the mobile hemi-arms 16 and 17.

The lock of hair is then wound around the two arms 4, 5 with a rotation movement of the device 1 around the axis X. Alternatively, according to an embodiment not shown, the assembly of the two arms 4 and 5 can be made to rotate with respect to the handle through an electric motor activated by the user through a suitable command.

When the lock of hair is wound, the arms 4, 5 are heated for a period of time necessary for the curling of the hair. During this time, the heating elements 24, 25 are supplied with power, so as to heat the arms 4 and 5; according to the design of the device 1, the electric supply and therefore the heating can be activated only when the lock of hair has been wound, or also before, in particular in a permanent manner.

Then, the device is made to slide away from the head of the person whose hair is being curled, possibly keeping the lock tight with the other hand so as to avoid or at least limit an unpleasant feeling of traction on the hair.

In such a way, during the sliding step, the lock always remains wound around the arms that are entirely heated, thus reducing the work time. Moreover, in order to carry out these operations it is not necessary to actuate clamps or other mechanical devices for locking or releasing the locks of hair, with the considerable advantage from the point of view of the manageability of the device of the present invention.

The curling obtained with the device of the present invention looks much better with respect to those that are obtained with the known methods using plates. It has been verified that the hair is curled and/or styled in a more dramatic manner, even close to the roots of the hair and also with thin hair, and the shape is kept over a longer time. Moreover, the time necessary to obtain the curling is about 40% shorter with respect to the use of conventional curling irons.

Figure 6:
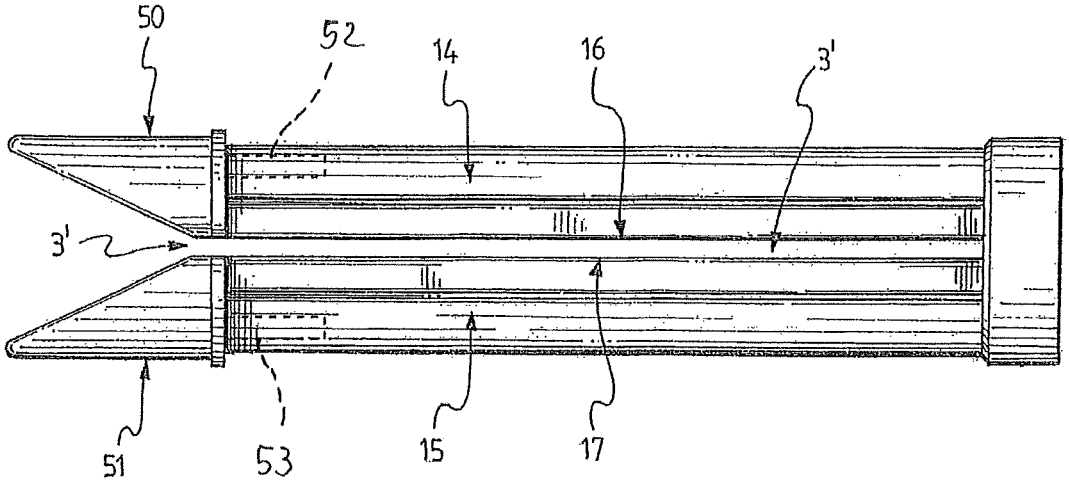
FIG. 6 is a side view of a second preferred embodiment of a device in accordance with the present invention.

With reference now to FIG. 6, a second preferred embodiment of a device in accordance with the present invention is shown, in which the only difference with the first embodiment shown in FIGS. 1-5 consists in the greater distance from 2 mm to 10 mm between the two flat faces 18 and 19 and therefore in the greater width of the slit 3', even in rest conditions. All the other characteristics are unvaried and therefore in FIG. 6 the same reference numerals are used, with the sole exception of the slit, which is indeed indicated with 3'.

This embodiment could be preferable for treating very thick locks.

Figure 7:
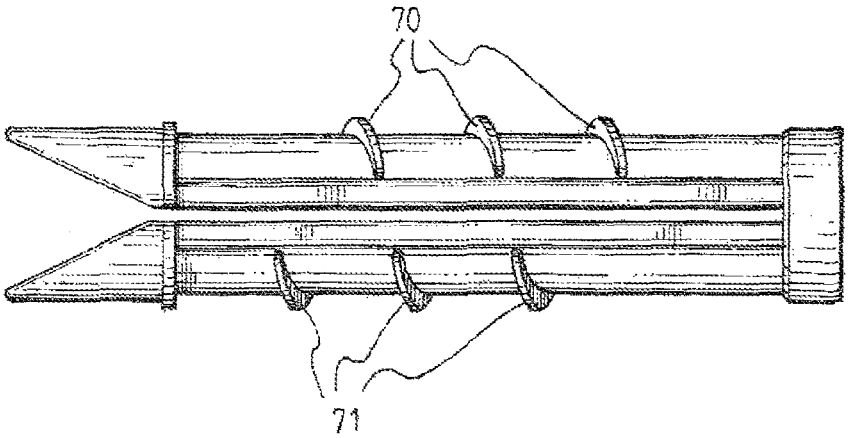
FIG. 7 is a side view of a third preferred embodiment of a device in accordance with the present invention.

With reference now to FIG. 7, a third preferred embodiment of a device in accordance with the present invention is shown, in which the arms 4, 5, above the respective convex faces 20, 21, have a series of ribs 70, 71 which make it possible to guide the positioning of the lock of hair during its winding around the arms 4, 5.

In particular, the ribs 70 on the convex face 20 of the first arm 4 are offset with respect to the ribs 71 on the convex face 21 of the second arm 5, i.e. not aligned with them.

This allows the lock of hair to be wound in an even better manner to undergo curling. Indeed, since the ribs of one arm are offset with respect to those of the other arm, it is possible, in the step of winding around the arms, to give the lock a diagonal direction with respect to the length of the arms, so as to direct the lock from one arm to the other, each time that winding is carried out, towards the space comprised between two successive ribs.

In such a way also the possibilities are minimised that the lock easily slides off from the device for curling hair before the curling step is completed and that the lock of hair winding over itself.

In view of the foregoing, it will be seen that several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, Thus, the breadth and scope of the present invention should not be limited by any of the above-described exemplary embodiments, but should be defined only in accordance with the following claims appended hereto and their equivalents.

What is claimed is:

1. A device for curling hair, comprising:

a handle comprising a one-piece monolithic portion at all operating conditions of the device;

a first arm;

a second arm;

said first and second arm being solidly fixed to said one-piece monolithic portion at a first end thereof, arranged side-by-side and parallel to one another and extending along a longitudinal axis, associated with said handle;

said device comprising a heater to heat at least one of said first and second arms;

each of said first and second arms further comprising a respective fixed hemi-arm, the fixed hemi-arm of either of said first and second arm being solid with the one-piece monolithic portion and with the fixed hemi-arm of the other of said first and second arm, and a respective mobile hemi-arm, elastically supported by said fixed hemi-arm;

wherein each of said first and second arms has a semi-cylindrical shape, with a first flat face fondled on said mobile hemi-arm and a second convex face formed on said fixed hemi-arm, said flat faces facing towards one another, said convex faces facing away from one another;

wherein said fixed hemi-arm and said mobile hemi-arm of said first and second arms comprise a metal; and wherein in a rest condition of the device, said mobile hemi-arm of said first arm and said mobile hemi-arm of said second arm are arranged a predetermined distance apart, with a slit from 2 mm to 10 mm being formed between the first flat faces of the mobile hemi-arms.

2. The device according to claim 1, wherein, in the rest condition of the device, said mobile hemi-arm of said first arm and said mobile hemi-arm of said second arm are alongside one another for the entire length of said arms.

3. The device according to claim 1, wherein said heater comprises a first and a second heating element, housed in a respective one of said mobile hemi-arms.

4. The device according to claim 1, wherein each of the mobile hemi-arms comprises a head positioned at a second end of the respective arm, on the opposite side with respect to the handle.

5. The device according to claim 4, wherein said head is made from heat-insulating material.

6. The device according to claim 1, wherein at least one of said arms comprises at least one rib, formed on the convex face of the respective fixed hemi-arm and extending transversally with respect to the longitudinal axis.

7. The device according to claim 6, wherein said ribs of the first arm are not aligned with said ribs of the second arm.

8. A device for curling hair, comprising:

a handle having a single, fixed longitudinal axis and comprising a one-piece monolithic portion in every operating condition of the device;

a first arm;

a second arm;

said first and second arm being solidly fixed to said one-piece monolithic portion at a first end thereof, arranged side-by-side and parallel to one another and to said longitudinal axis, associated with said handle;

said device comprising a heater to heat at least one of said first and second arms; and each of said first and second arm further comprising a fixed hemi-arm, the fixed hemi-arm of any of said first and second arm being solid with the one-piece monolithic portion and with the fixed hemi-arm wherein each of said first and second arms has a semi-cylindrical shape, with a first flat face formed on said mobile hemi-arm and a second convex face formed on said fixed hemi-arm, said flat faces facing towards one another, said convex faces facing away from one another of the other of said first and second arm and a mobile hemi-arm, elastically supported by and movable relative to said fixed hemi-arm;

wherein said fixed hemi-arm and said mobile hemi-arm of said first and second arms comprise a metal; and wherein in a rest condition of the device, said mobile hemi-arm of said first arm and said mobile hemi-arm of said second arm are alongside one another for the entire length of said arms, with a slit from 2 mm to 10 mm being formed between the mobile hemi-arms.

9. The device according to claim 8, wherein, in the rest condition of the device, said mobile hemi-arm of said first arm and said mobile hemi-arm of said second arm are alongside one another for the entire length of said arms.

10. The device according to claim 8, wherein said heater comprises a first and a second heating element, housed in a respective one of said mobile hemi-arms.

11. The device according to claim 8, wherein each of the mobile hemi-arms comprises a head positioned at a second end of the respective arm, on the opposite side with respect to the handle.

12. The device according to claim 11, wherein said head is made from heat-insulating material.

13. The device according to claim 8, wherein at least one of said arms comprises at least one rib, formed on the convex face of the respective fixed hemi-arm and extending transversally with respect to the longitudinal axis.

14. The device according to claim 13, wherein said ribs of the first arm are not aligned with said ribs of the second arm.

* * * * *